US005117406A

United States Patent [19]

Sullivan

[11] Patent Number: 5,117,406

[45] Date of Patent: May 26, 1992

[54] WATCHBAND FASTENER AND ARRANGEMENT

[76] Inventor: Scott L. Sullivan, 1801 Crystal Dr. (709), Arlington, Va. 22202

[21] Appl. No.: 652,133

[22] Filed: Feb. 7, 1991

[51] Int. Cl.[5] ..... G04B 37/00

[52] U.S. Cl. ..... 368/282; 368/281

[58] Field of Search ..... 368/276, 280, 281, 282, 368/283; 224/165-180

[56] References Cited

U.S. PATENT DOCUMENTS

| | | | |
|---|---|---|---|
| 2,482,660 | 9/1949 | Dewey | 368/282 |
| 2,840,286 | 6/1958 | Schermerhorn | 368/282 |
| 3,585,794 | 6/1971 | Klingenberg | 368/282 |
| 4,855,972 | 8/1989 | Eiss | 368/282 |

FOREIGN PATENT DOCUMENTS

| | | | |
|---|---|---|---|
| 0463222 | 2/1914 | France | 224/167 |
| 0050857 | of 1941 | France | 224/17 |
| 2186785 | 8/1987 | United Kingdom | 224/177 |

*Primary Examiner*—Bernard Roskoski

[57] ABSTRACT

A fastener for connecting a fastening end of a watchband to a watch case wherein the watchband includes a central longitudinal axis and the fastening end defines an end axis. The fastener includes a shaft positioned along the end axis and means for fixing the fastening end of the watchband to the shaft. Means are provided for securing a sole end of the shaft to the watch case. The securing means is offset with respect to the central longitudinal axis.

13 Claims, 7 Drawing Sheets

WATCHBAND FASTENER AND ARRANGEMENT

FIELD OF THE INVENTION

The present invention relates generally to watches, and more particularly, to the fastening arrangement by which watch cases are attached to their watchbands.

BACKGROUND OF THE INVENTION

Ever since the clock was miniaturized to form the watch, there have been a number of ways to attach the new type of timepiece to a person or his clothing. Among these are pocket watches, clip-on watches, ring watches, and of course, today's popular version, the wristwatch.

The popularity of the wristwatch has generated a myriad of watch designs for both the watch case and the watchband. The most traditional designs include a generally circular, or rectangular watch case having two, somewhat rectangular, elongated watchband segments, each attached to the watch case at opposing sides, usually adjacent the numeral "12" and "6", respectively (of the watch face). Each band segment is attached to the watch case with a pair of band support arms (hereinafter called "support arm") which are generally formed integrally with the watch case. An inside face of each support arm includes a small detent for receiving one end of a spring-loaded pin. The two ends of the pin engage the two respective detents and bridge the pin between the two adjacent support arms. The watchband is looped around this pin and is thereby attached to the watch case.

Another commonly used type of fastener for securing the watchband to the watch case is shown by U.S. Pat. No. 302,134 issued to Woomer, Jul. 11, 1989. The watch of U.S. Pat. No. 302,134 includes a single band support arm fixed at opposing ends of the watch case and located centrally of each band end. In this case, each support arm (two per watch) includes a threaded opening for receiving two band securement screws, two screws are used to secure each band segment to their respective support arm. The result is a watchband that is symmetrically attached to a watch case so that the watch case has the appearance of being more "delicate" than the prior watch case-to-band fastening arrangements including those having two support arms for each band segment.

OBJECTS OF THE INVENTION

An object of the invention is to provide a fastening system for attaching a watchband to a watch case so that the watch case of the resulting wristwatch assembly appears to be detached from the watchband (or band segments) thereby creating a "very delicate" and aesthetically pleasing wristwatch.

Another object of the invention is to provide such a "delicate" locking wristwatch while maintaining very high band-to-case attachment strength and comfort to the wearer.

Another object of the invention is to provide a watch case/band attachment assembly which is asymmetrical with respect to the longitudinal axis defined by the centerline of the watchband.

Yet another object of the invention is to provide a fastener to secure a watchband to a watch case that allows relative movement of the entire watch case about a predetermined axis with respect to the watchband.

SUMMARY OF THE INVENTION

A fastener for connecting a fastening end of a watchband to a watch case wherein the watchband includes a central longitudinal axis and the fastening end defines an end axis. The fastener includes a shaft positioned along the end axis and means for fixing the fastening end of the watchband to the shaft. Means are provided for securing a sole end of the shaft to the watch case. The securing means is offset with respect to the central longitudinal axis.

DETAIL DESCRIPTION OF THE PREFERRED EMBODIMENT

Figure 1:
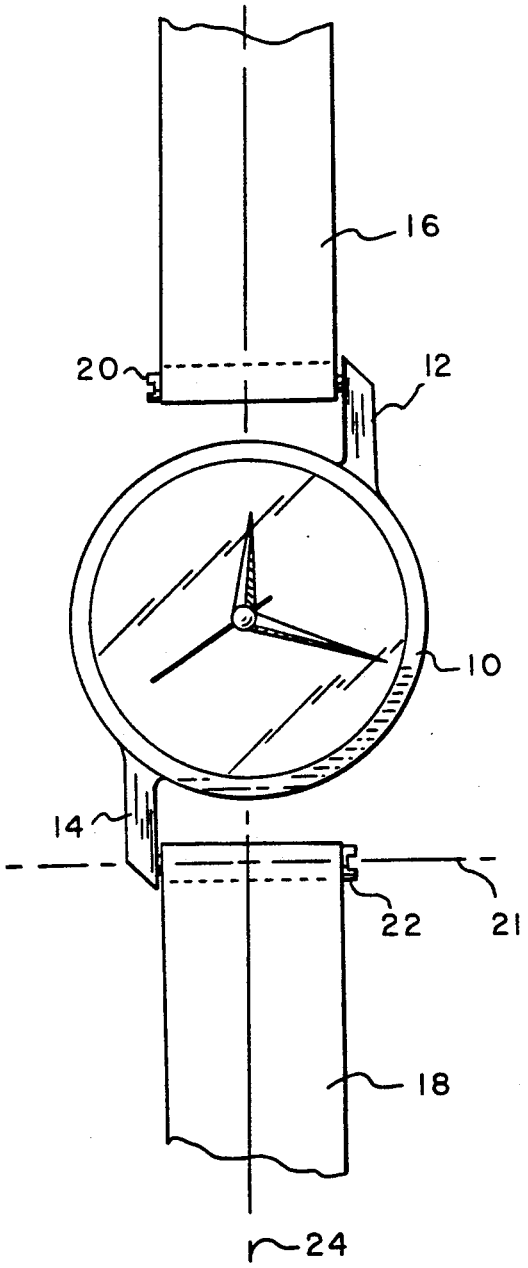
FIG. 1 is a plan view of one watch design showing one particular embodiment of the invention.

Referring to FIG. 1, a first embodiment of the invention is shown, including a watch case 10, arm supports 12 and 14, watchband segments 16 and 18, and watchband bolts 20 and 22, respectively. Following a basic concept of the invention, each watchband segment 16 and 18 is attached to the watch case 10 with a single offset support arm 12 and 14, respectively, using a single watchband bolt 20 and 22. As shown in FIG. 1, the watchband bolt lies along an end axis 21. The term "offset" is used hereinafter with respect to the longitudinal centerline of the watchband, referenced by numeral 24 in FIG. Any item which is not positioned along the centerline 24 as viewed from the front is considered "offset". The offset positioning of the single support arm, as shown in FIG. 1, distinguishes the present invention from the single centered (along the centerline) support arm of the prior art (as discussed above).

Although each band segment 16, 18 is respectively positioned in a conventional manner, i.e., adjacent the numeral "12" and the numeral "6" of the watch, the support arms 12 and 14 are not conventionally positioned. The support arm 12 is positioned, in the example of FIG. 1, between the numerals "1" and "2" of the watch, whereas the support arm 14 is positioned between the numerals "7" and "8" of the watch. The positioning of the support arms 12, 14 as shown in FIG. 1 (along a diagonal axis with respect to the watchband centerline 24) is herein defined as a "positive opposing diagonal" arrangement. A "negative opposing diagonal" arrangement would have the support arm 12 (see FIG. 1) positioned between the numerals "10" and "11" of the watch, and the support arm 14 positioned between the numerals "4" and "5" of the watch: rotated about the centerline 24 by 180 arc degrees.

The offset positioning of the band support arms 12 and 14 with respect to the watchband centerline 24 create an illusion of separation between the watchband and the watch case.

The fastening system used to secure the watchband segments 16 and 18 to the watch case 10 of FIG. 1 does not limit the strength of the watch case or the support arms 12, 14, as further described below.

Figure 2:
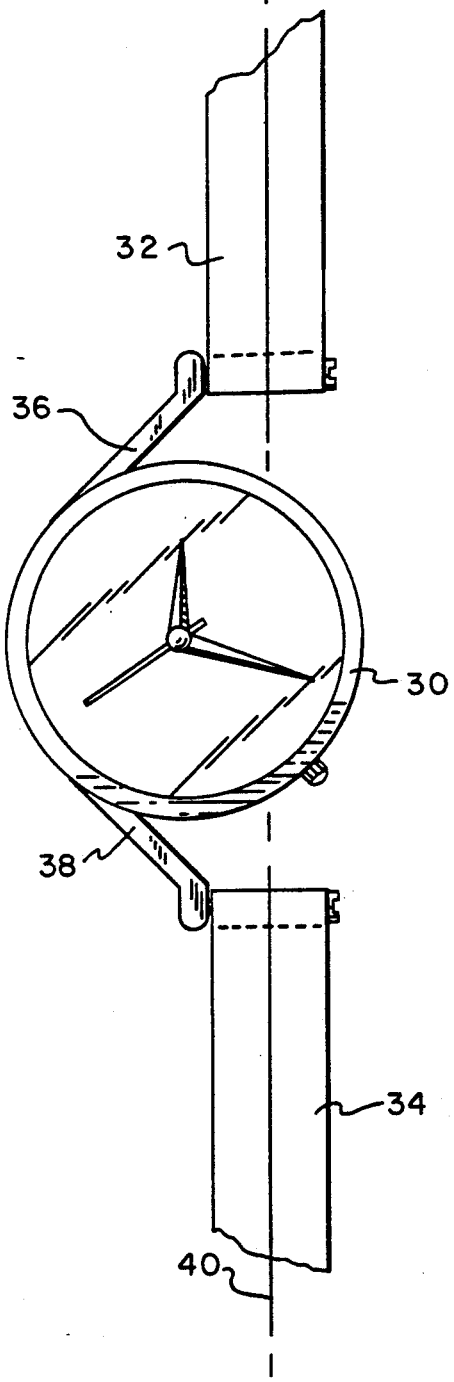
FIG. 2 is a plan view of a second watch design showing a second embodiment of the invention.

Referring to FIG. 2, the same concept of the invention is used to secure a watch case 30 to band segments 32 and 34; a single offset support arm 36, 38 for each watchband segment. However, in this example, the support arms 36, 38 extend from the watch case 30 from the same side of the watchband centerline (centerline 40 in FIG. 2) and are shaped so that the watch case 30 is also offset from the centerline 40. The offset watch case 30 and the individual offset support arms 36, 38 help emphasize the illusion of separation between the watch case 30 and the watchband segments 32, 34.

In this example (refer to FIG. 2), the support arm 36 stems from a point along the watch case 30, which lies adjacent to the numeral "11" of the watch, to a point which is in-line with the numeral "6". The support arm 38 stems from a point along the watch case 30 which lies adjacent to the numeral "7" of the watch, to a point which is in-line with the numeral "12".

Of course any shape watch case may be used with the present invention, as well as any shape support arms, as long as only one support arm is used to secure one band segment. The term "band segment" is used to refer to any watchband made from plastic, leather, metal or any other material and which is of any shape. The watchband used with the invention may be the type including a closed-loop of spring-loaded interlocking links (typically metal) or the standard two-piece buckle-type, common with leather and plastic bands segments. The shape of the band is preferably rectangular in cross section, but may also be shaped circular or tubular in cross section.

The watch case of the invention may be made from any suitable material such as metal or plastic. The material chosen, of course, must be strong enough to support the watch and endure any stress applied to the individual band support arms. The required strength of the material depends, in part, on the shape of the band support arms, as well as the type and material of the band used.

As already discussed above, and shown in FIGS. 1 and 2, the band securement bolt 20, 22 (hereinafter called "band bolt") used in all the embodiments of the invention are each supported by the watch case at a single end of the bolt. Because of the leverage advantage against both the bolt and its support arm, these parts will most likely be subjected to potentially higher mechanical stresses than prior art band pins and support arms. The band bolts are therefore preferably made from a strong material, such as steel. The support arm, if formed integral with the watch case may be bossed for handling such expected torque-related mechanical stresses. The support arms and the entire watch may be similarly made from a strong material such as titanium or steel to overcome any wear-stress or fatigue.

Figure 4:
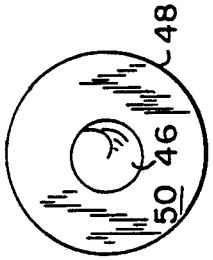
FIG. 4 is an end view of the band bolt shown in FIG. 3, taken along the lines 4—4 of FIG. 3.
Figure 3:
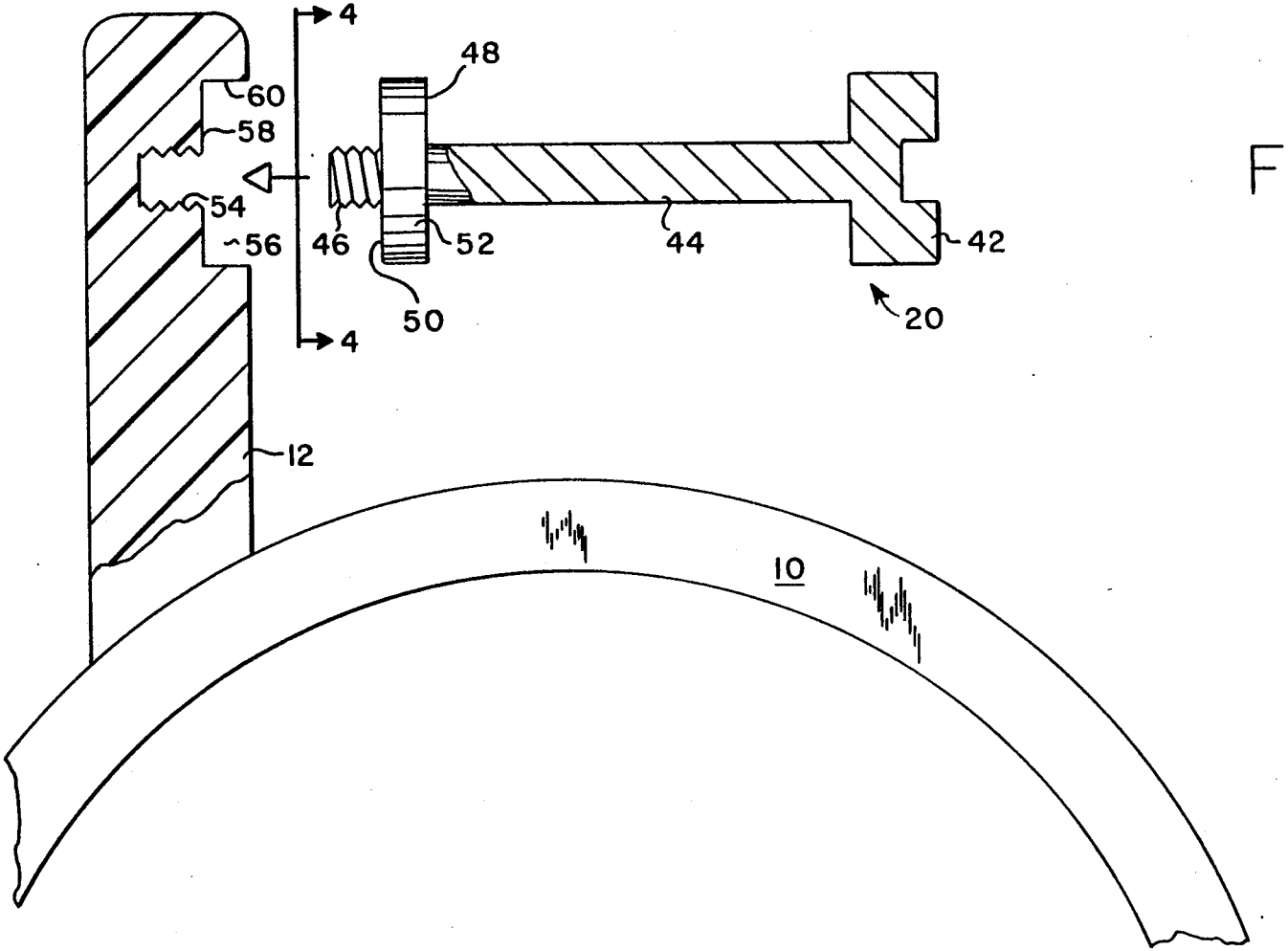
FIG. 3 is a partial cross-sectional front view of an embodiment of the invention showing details of a band bolt and a support arm.

Using the bolt 20, as an example, and referring to FIG. 3, the bolt 20 integrally includes a head 42, a shaft 44, and a threaded end 46. The bolt 20 also includes an integral flange portion 48 which is adjacent to the threaded end 46 and includes a flat front surface 50 (shown more clearly in FIG. 4) facing the threaded end 46 and a defined circumferential wall surface 52, formed preferably at 90 arc degrees from the flat surface 52.

As shown in FIG. 3, the band support arm 12 includes a threaded opening 54 for receiving the threaded end of the bolt 20 and a concentrically located recess 56 which includes a flat surface 58 and a circular wall surface 60 formed at 90 arc degrees from the flat surface 58. When bolt 20 is threaded into the threaded opening 54 of the support arm 12, the front flat surface 50 of the flange portion 48 abuts the flat surface 58 of the recess 56 of the support arm 12. The tight engagement between the flat surface 50 of the bolt 20 and the flat surface 58 of the support arm 12 provide sufficient rigidity and support to the secured band segments 16, 18 to overcome any mechanical related stress caused, for example, by pulling the two band segments 16, 18 away from each other. The tolerance of fit of the flange portion 48 within the recess portion 56 of the support arm 12 will dictate the degree of mechanical engagement and the amount of mechanical support provided. The support provided by this mechanical engagement of the flange portion 48 of the bolt 20 and the recess portion 56 of the support arm 12 will also prevent damage to the threaded portions of both the bolt 20 and the support arm 12 due to any mechanical stress exerted on the shaft portion 44 of the bolt 20.

Figure 5:
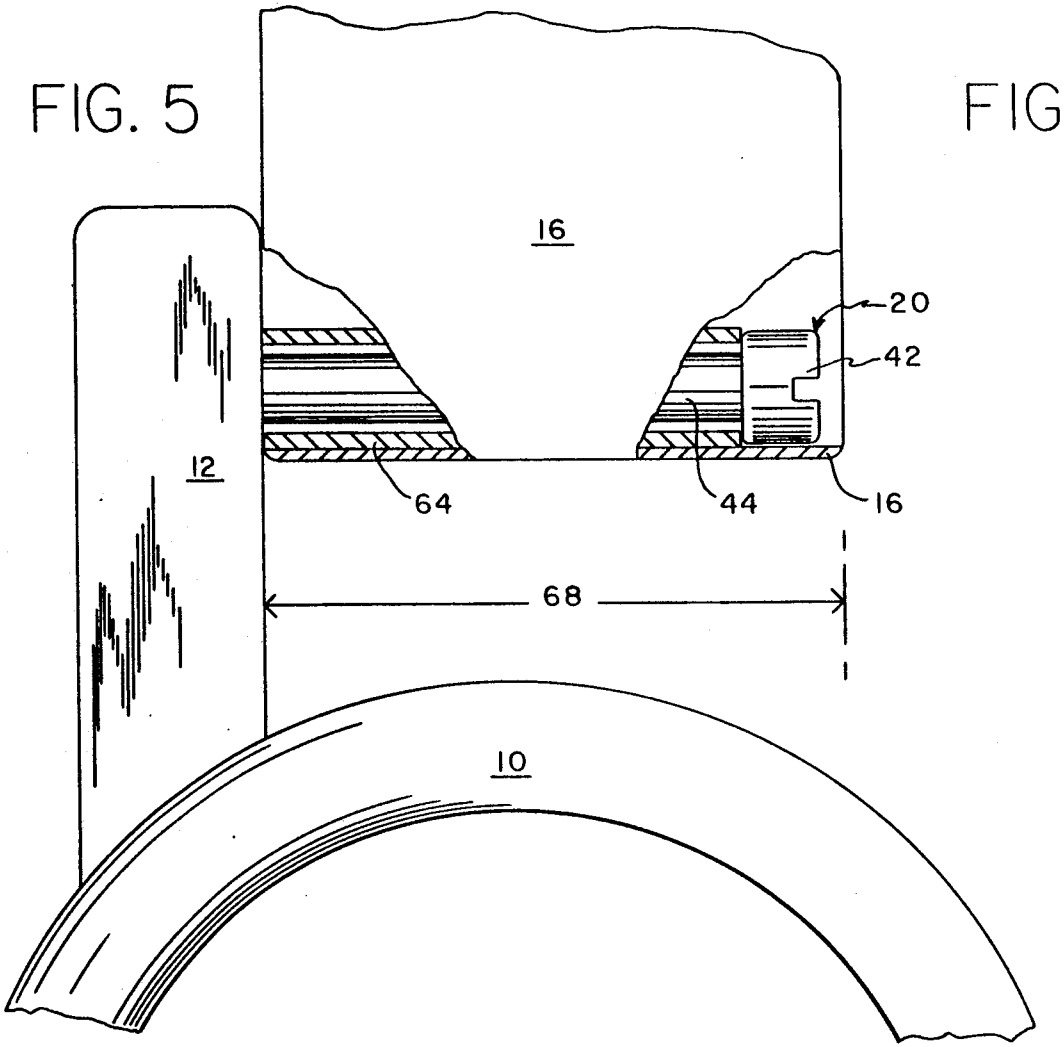
FIG. 5 is a partial cross-sectional side view of another embodiment of the invention showing a recess band bolt.
Figure 6:
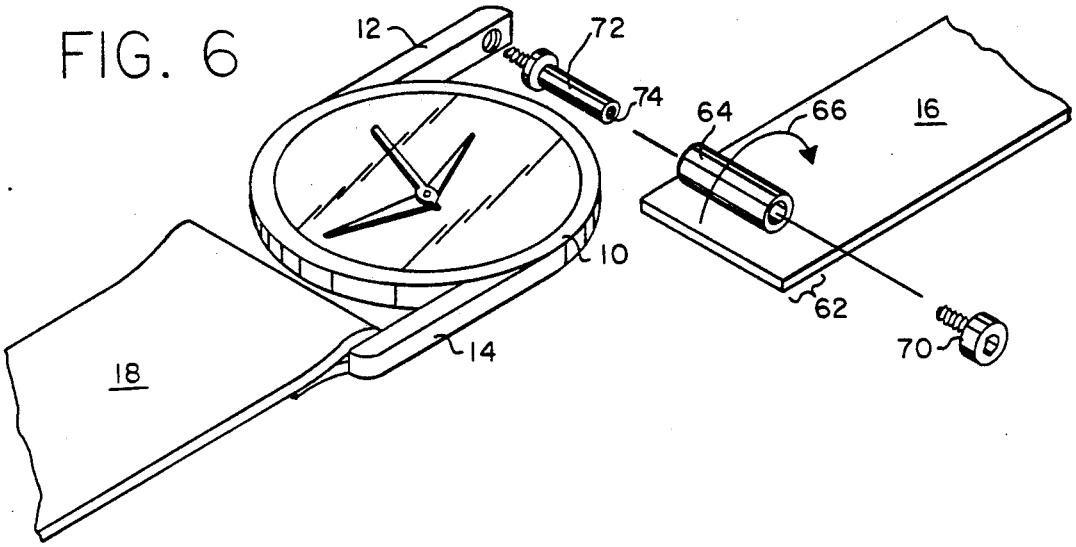
FIG. 6 is an isometric partially exploded view of another embodiment of the present invention.

Referring now to FIGS. 5 and 6, another embodiment of the fastener invention is shown wherein the head portion 42 of the band bolt 20 is hidden from view within the "loop" of the band segment 16. The purpose of this embodiment of the invention is to fasten the band segment 16, for example, to the support arm 12, but to do so in a subtle and perhaps deceptive manner. The previously described embodiments of the watch designs shown in FIGS. 1 and 2 have their band bolts 20, 22 exposed.

The fastener assembly of FIG. 5 and FIG. 6 includes the support arm 12, for example, stemming from the watch case 10. A fastening end 62 of the band segment 16 (refer now to FIG. 6) is looped (the looping action is indicated by arrow 66 of FIG. 6) around and securely fixed to a hinge tube 64. The hinge tube 64 is a small tube shorter in length than the width of the fastening end of the band segment (distance 68 of FIG. 5), and preferably made from a metal such as brass. The hinge tube may, of course, be made from other materials as well including other metals, plastics and also leather. The hinge tube 64, depending on its material, must will fall off the watch case Any appropriate method may be used for this purpose, for example, adhesives, glue melts, or just friction from a tightly sown loop about the hinge tube. The hinge tube 64 is best suited for watchbands made from leather or fabric. Watchbands made from metal or plastic may be formed to include an integral hinge tube 64 or a functional equivalent.

Since the hinge tube 64 is shorter in length than the width 68 of the loop of the band segment 16, the head portion 42 of the bolt 20 may be concealed within the loop portion as shown in FIG. 5. Of course, the diameter of the head portion 42 must be greater than (preferably equal to the outside diameter of the hinge tube 64) the inside diameter of the hinge tube 64 so that the bolt 20 may retain the hinge tube 64 (and therefore the entire band segment 16) against the support arm 12. The shaft portion 44 of the bolt 20 must be less (preferably only slightly less) than the inside diameter of the hinge tube 64. The length of the hinge tube 64 and the length of the head portion 42 of the bolt 20 preferably is equal to or less than the length of the loop of the band segment 16 so that the means for attaching the band segment 16 to the support arm 12 is concealed. The length of the shaft portion 44 of the bolt 20 is preferably such that the hinge tube may freely turn about the shaft 44 with bolt 20 in its fully tightened position.

To accommodate the preferable flange portion 48 of the bolt 20 (refer back to FIG. 3), the diameter of the flange must be smaller than the inside diameter of the hinge tube 64. Also, the bolt 20 may be split (as shown in FIG. 6) to include an outer cap bolt 70 and a stud assembly 72. In this case, the stud assembly 72 may include a larger diameter flange portion 48 and still accept the hinge tube 64. The outer cap bolt 70 would be threadable into the now open end 74 of the shaft portion of the stud assembly 72.

The support arms discussed in the previous embodiments were fixed to the watch case and preferably formed integrally with the formation of the watch case. However, in accordance with another embodiment of the invention, the support arms may be independently formed and separately attached to the watch case so that they may or may not move relative to the watch case.

Figure 7:
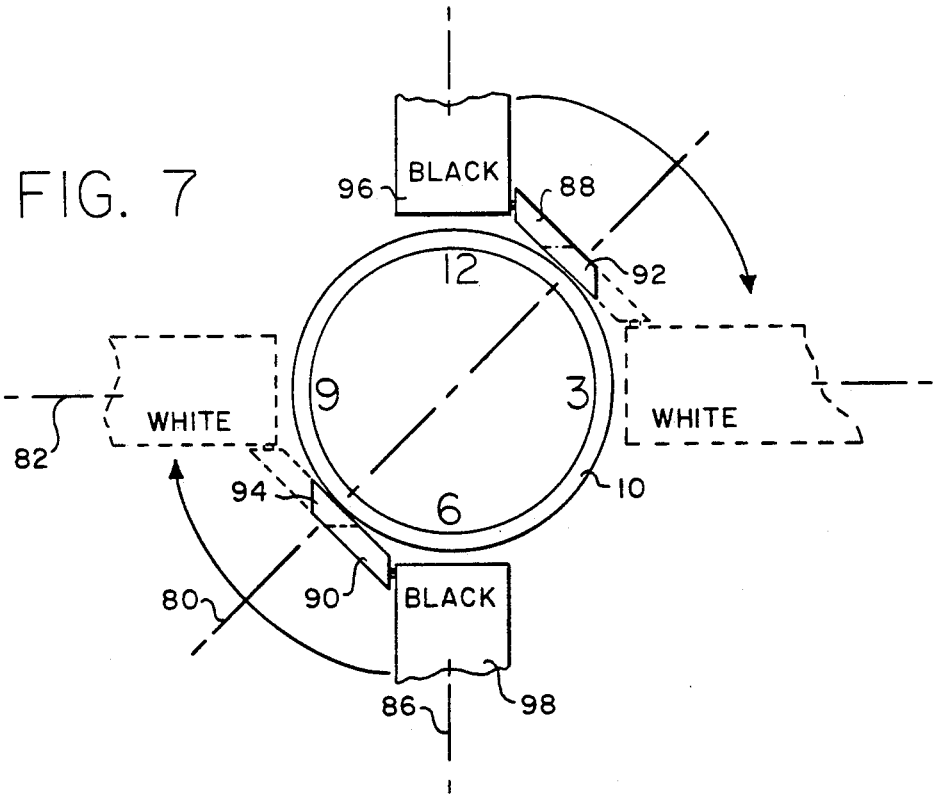
FIG. 7 is a conceptual plan front view of a watch in accordance with yet another embodiment of the invention.

The concept of independent and moveable support arms is shown in FIG. 7. A watch case 10 is shown in relation to a diagonal axis 80. The axis 80 lies, in this case, at 45 arc degrees with respect to a horizontal axis 82 which lies over the numerals "3" and "9" of the watch and with respect to a vertical axis 86 which lies over the numerals "12" and "6" of the watch. The support arms 88 and 90 are pivotally connected to a portion of the watch case 10, such its side wall, in a positive diagonal arrangement along the diagonal axis 80 (similar to the watch of FIG. 1). The support arms 88, 90 are, in this case, shaped like a parallelogram, each arm having two pairs of parallel edges. One parallel edge pair is perpendicular to the diagonal axis 80, while the other pair is (in the solid-lined figure of FIG. 7) parallel to the vertical axis 86. The two support arms 88, 90 are pivotally attached at a pivot end 92, 94, respectively, to the watch case 10 using any appropriate method, such as a recessed bolt or rivet (not shown), so that each support arm 88, 90 may swing about the axis 80, in a plane which is perpendicular to the axis 80. The other end (remote to the pivot point) of each support arm 88, 90 is provided with a threaded opening and, as described above, fastens band segments 96 and 98, respectively, to the support arms.

Figure 11:
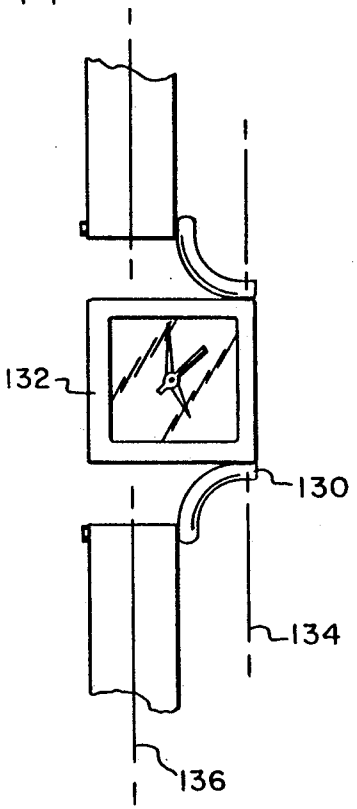
FIG. 11 is a front view of a watch in accordance with another embodiment of the invention.
Figure 9C:
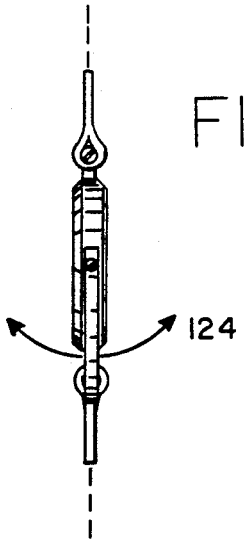
FIG. 9*c* is the side view of the watch of FIG. 9a, showing a pivotal support arm.
Figure 9A:
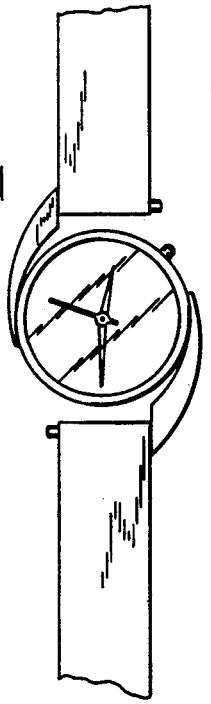
FIG. 9*a* is a front view of a design of a watch in accordance with the invention.
Figure 9B:
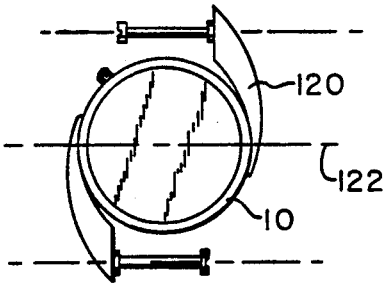
FIG. 9*b* is the back view of the watch of FIG. 9*a;*
Figure 10A:
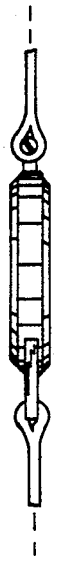
FIG. 10*a* is side view of a watch in accordance with another embodiment of the invention.
Figure 10B:
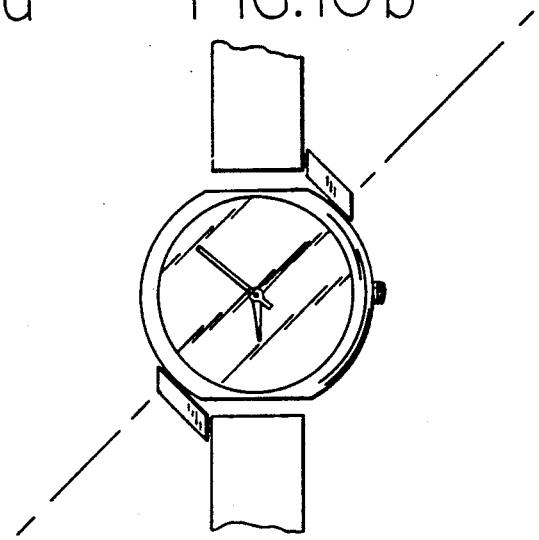
FIG. 10*b* is the front view of the watch of FIG. 10*a* showing a diagonal pivoting axis.
Figure 10C:
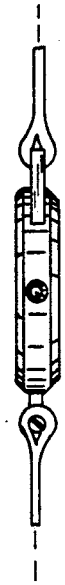
FIG. 10*c* is the inverted side view of the watch of FIG. 10*a;*
Figure 10D:
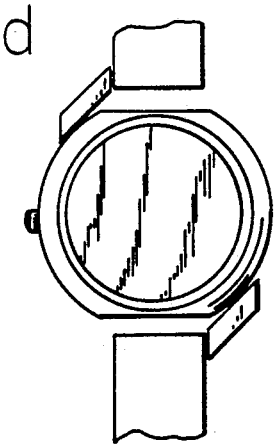
FIG. 10*d* is the back view of the watch of FIG. 10*a;*
Figure 12B:
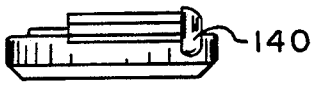
FIG. 12*b* is a top view of the watch of FIG. 12*a;*
Figure 12A:
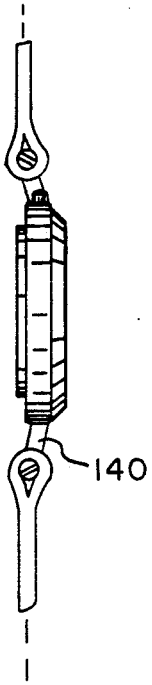
FIG. 12*a* is a side view of a watch in accordance with another embodiment of the invention.
Figure 12C:
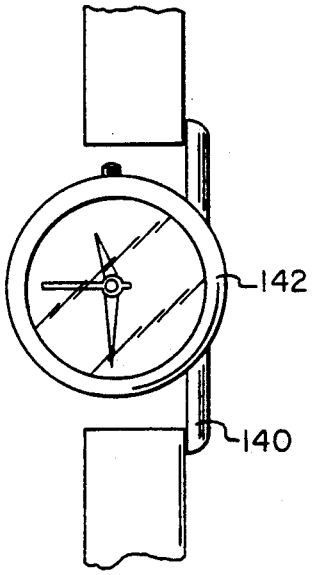
FIG. 12*c* is a front view of the watch of FIG. 12*c;*
Figure 12E:
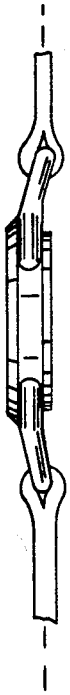
FIG. 12*e* is an inverted side view of the watch of FIG. 12*a.*
Figure 12D:
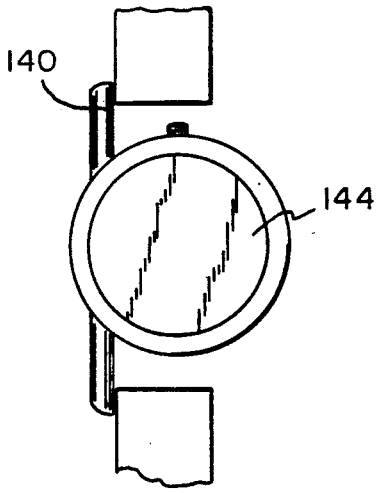
FIG. 12*d* is a back view of the watch of FIG. 12*a;*.

The support arms 88, 90 may be pivoted along any axis at any angle with respect to the center band axis 86. Two or more pivoting axes may be followed. In FIG. 9a-c, the support arms 120 are pivotal along a horizontal axis 122, (perpendicular to the center band axis) as indicated by arrows 124. In FIG. 11, two support arms 130 are pivotally connected to the watch case 132 along a vertical axis 134 (parallel to the central band axis 136).

In operation of the embodiment shown by FIG. 7, the watch band segments 96, 98 may be swung from their vertical position (axis 86), prior to wearing the watch, about the diagonal axis 80 to the horizontal position along axis 82 (shown in FIG. 7 in dashed lines). When "flipped" about the diagonal axis 80, the band segments 96 and 98 reveal their underside, which is preferably a different color, design or texture (or otherwise distinguishable) from their topside shown along the vertical axis 86. For example, the band segments 96 and 98 may have a black top surface and a white underside. By providing pivotal support arms 88, 90 in this arrangement shown in FIG. 7, the wearer of the watch may quickly and easily change the band color of the band segments 96, 98, depending on, perhaps, the particular occasion; for example, a formal watch (black band) to a more "fun" watch (white or a bright color band).

FIGS. 10*a-d* show a design example of a watch similar to the concept watch discussed above with respect to FIG. 7.

The above described flipping action of the band segments 96, 98 also changes the orientation of the watch face with respect to the wearer's wrist on which the watch is worn. This feature may be used to make a more interesting watch (i.e., formal watch/party -fun watch, etc.). This watch-case flipping action is described in greater detail below.

Furthermore, the flipping action may also be applied to the watch case 10 itself, wherein the band segments 96, 98 remain along the vertical axis 86, for example, and the watch case 10 is pivoted about the diagonal axis 80 (instead of the band segments 96, 98). The backside of the watch (not shown) may include a aesthetically pleasing textured design or another watch face having hands which are connected to the same output shafts as the watch of the front-side (shown in FIG. 7). The result would be a watch having a clockwise-moving front-side watch and a counterclockwise-moving flip-side watch. To allow for flipping the watch case while it is worn on the wrist of the wearer, the support arms 88, 90 may further be attached to the watch case using a flexible member, such as a tightly coiled spring or very tough rubber. Such a flexible pivot point would "give" and allow the watch case to be flipped.

In accordance with yet another embodiment of the invention, the pivotal support arms discussed above may include spring biasing to hold them, for example close to the surface of the wearer's wrist, regardless of the tension of the watchband.

Figure 8A:
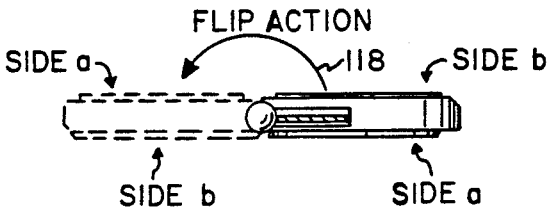
FIG. 8*a* is a top view of the watch of another embodiment of the invention showing the concept of a flip watch.
Figure 8C:
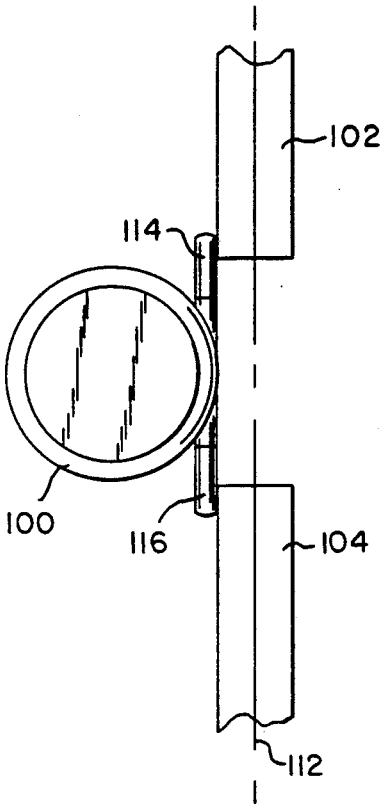
FIG. 8*c* is a front view of the embodiment of FIG. 8*a* showing the flip watch in its "flipped" backside position.
Figure 8B:
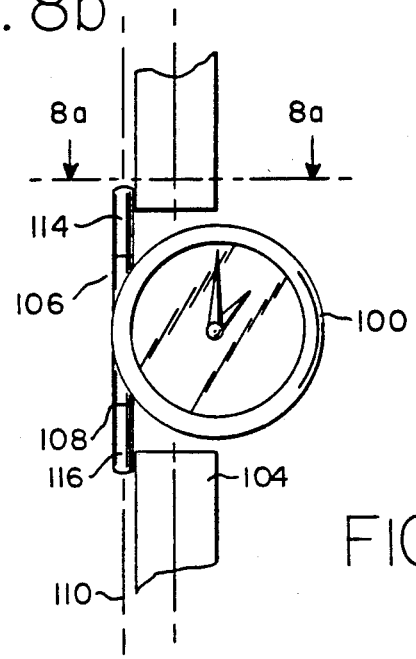
FIG. 8*b* is a front view of the embodiment of FIG. 8*a* showing the flip watch in its right-side up position.

Referring now to FIGS. 8*a–b*, the watch case 100 of this particular embodiment of the invention is connected to the band segments 102 and 104, by support arms 106 and 108, respectively. In this case, the support arms are located along an axis 110 which is parallel to the central band axis 112, and tangent to the watch case 100. The support arms 106, 108 include end portions 114, 116, respectively, which may pivot about the axis 110. When worn, the watch case 100 may likewise pivot about the axis 110 to a point which is "outside" (very offset) from between the two band segments 102, 104 (as shown by FIG. 8*c*), yet still secured to the wrist by the same band segments. The flip action is shown in FIG. 8*a* by arrow 118. As before, this flip action may be spring biased to retain the watch case 100 in a number of predetermined positions, such as flipped right-side-up (FIG. 8*b*) or right-side-down (FIG. 8*c*), or even held in a vertical position, perpendicular from the wearer's wrist (not shown).

FIGS. 12*a–e* show another design example of a watch having the fastener in accordance with one embodiment of the present 42 and slightly bent backwards towards the backside 144 of the watch case.

In yet another embodiment of the invention, the support arm is incorporated with the watch case by way of a recess portion within the backside of the case. The band bolt to hold the band segment is received by an opening located in a wall defined by the recess portion. The wall and the recess are hidden from view of the watch from the front.

What is claimed is:

1. In combination, a fastener for connecting a fastening end of a watchband to a watch case, said watchband having a central longitudinal axis, said fastening end defining an end axis non parallel to said central axis, said fastener comprising in combination:

a shaft positioned along said end axis substantially parallel to said end axis, said shaft having an open end and a securable end;

means for fixing said fastening end of said watchband to said shaft between said open end of said shaft and said securable end of said shaft; and means for securing said securable end of said shaft to said watch case, said securable end of said secured shaft being offset with respect to said central longitudinal axis of said watchband, said open end of said secured shaft being unsecured and remote to said watch case.

2. A fastener combination according to claim 1, wherein said securable end of said shaft is integrally formed with said watch case.

3. A fastener combination according to claim 1, wherein said shaft is a bolt and said securable end is a threaded end of said bolt and said open end is a bolt head of said bolt, said bolt head of said bolt is located remote from said watch case.

4. A fastener combination according to claim 3, wherein said watchband is positioned about said bolt between said threaded end and said bolt head, said bolt head preventing detachment of said watchband from said bolt.

5. A fastener combination according to claim 3, wherein said bolt has a flange portion adjacent said threaded end which abuts a portion of said watch case and thereby provides rigidity to said bolt.

6. A fastener combination according to claim 5, wherein said portion of said watch case includes a threaded opening for receiving said threaded end of said bolt, and a recess which is concentrically located about said threaded opening for receiving said flange portion of said bolt.

7. A fastener combination according to claim 3, further comprising a sleeve which fits loosely about said shaft, said inner diameter of said sleeve being less than said outer diameter of said bolt head, said fastening end of said watchband being bonded around said sleeve.

8. A fastener combination according to claim 7, wherein said outer diameter of said sleeve is generally equal to or greater than said outer diameter of said bolt head.

9. A fastener combination according to claim 8, wherein said fastening end of said watchband is sufficiently wide to cover said bolt head, thereby hiding said bolt head from view.

10. A fastener combination according to claim 1, wherein said watch case includes an attached support arm having an open end which receives said securable end of said shaft.

11. A fastener combination according to claim 10, wherein said support arm is pivotally connected along a pivot axis to said watch case so that said watchband and said support arm may together move with respect to said watch case, about said pivot axis.

12. A fastener combination according to claim 10, wherein said support arm is pivotally connected to said watch case so that said watch case may pivot with respect to said support arm and watchband, about said pivot axis.

13. A wristwatch, comprising:

a watch case enclosing a timing mechanism;

a watchband having a fastening end and a central longitudinal axis, said fastening end defining an end axis non parallel to said central axis; and a fastener for connecting said fastening end of said watchband to said watch case, said fastener including:

a shaft having a securable end and an open end, said shaft positioned substantially parallel to said end axis;

means for fixing said fastening end of said watchband to said shaft between said securable end and said open end; and means for securing said securable end of said shaft to said watch case, wherein said securable end of said shaft is offset with respect to said central longitudinal axis and said open end of said secured shaft remains unsecured and remote to said watch case.

* * * * *